US005502961A

United States Patent [19]

Tone et al.

[11] Patent Number: 5,502,961

[45] Date of Patent: Apr. 2, 1996

[54] FALSE TWISTER AND METHOD FOR CONTROLLING SAME

[75] Inventors: Shoichi Tone, Kyoto; Kazuyasu Hirai, Nagaokakyo, both of Japan

[73] Assignee: Murata Kikai Kabushiki Kaisha, Kyoto, Japan

[21] Appl. No.: 364,851

[22] Filed: Dec. 27, 1994

Related U.S. Application Data

[63] Continuation of Ser. No. 107,952, Aug. 17, 1993, abandoned.

[30] Foreign Application Priority Data

Aug. 31, 1992 [JP] Japan ..... 4-232341

[51] Int. Cl.[6] ..... D01H 7/46; D01H 7/92

[52] U.S. Cl. ..... 57/264; 57/336

[58] Field of Search ..... 57/264, 265, 336, 57/93

[56] References Cited

U.S. PATENT DOCUMENTS

| | | | |
|---|---|---|---|
| 4,144,700 | 3/1979 | Tarai et al. | 57/264 |
| 4,377,932 | 3/1983 | Dammann et al. | 57/336 |
| 4,384,494 | 5/1983 | Taylor | 57/264 X |
| 4,402,179 | 9/1983 | Dammann et al. | 57/336 |
| 4,408,448 | 10/1983 | Bauer et al. | 57/336 |
| 4,910,953 | 3/1990 | Mirabel et al. | 57/336 |

FOREIGN PATENT DOCUMENTS

| | | | |
|---|---|---|---|
| 40434725 | 11/1992 | Japan | 57/264 |
| 2090293 | 7/1982 | United Kingdom | 57/336 |

*Primary Examiner*—William Stryjewski
*Attorney, Agent, or Firm*—Loeb and Loeb

[57] ABSTRACT

A false twister which nips a yarn between crossed belts and impart twist and feed to the yarn includes a sensor for detecting an untwisting tension of the yarn portion located downstream of the belts and the untwisting tension detected by the sensor is controlled to a target value of an untwisting tension by adjusting a contact pressure between the belts or a running speed of the belts.

8 Claims, 8 Drawing Sheets

FALSE TWISTER AND METHOD FOR CONTROLLING SAME

This is a continuation of application Ser. No. 08/107,952 filed on Aug. 17, 1993, now abandoned.

BACKGROUND OF THE INVENTION

1. Field of the Invention

The present invention relates to a false twister which nips yarn between crossed belts and imparts twist and feed to the yarn. Particularly, the invention is concerned with a false twister capable of controlling an untwisting tension of yarn in a simple construction to improve the yarn quality and is concerned with a controlling method of a false twister.

2. Prior Art

The construction of a drawing and false-twisting machine (draw texturizing machine) using this type of false twisters will now be described with reference to FIG. 5. The drawing and false-twisting machine is constituted by false twist units 1 which are arranged in a large number (210 spindles) side,by side in the direction perpendicular to the paper surface. Each false twist unit 1 has a first feed roller 3 for drawing out yarn (filament yarn) Y from a feed package 2 supported by a creel stand 2*a*. The yarn Y from the first feed roller 3 passes a primary heater and a ballooning plate 5 successively in this order, then is false-twisted by means of a false twister (nip twister) 6. The yarn Y thus false twisted passes a second feed roller 7, a secondary heater 8 and a third feed roller 9 successively in this sequence and is taken up as a take-up package 10 by means of a winder 10*a*. As a result, bulkiness is given to the yarn Y.

The false twister 6 is provided with a pair of crossed belts 11 and 12 to nip, twist and feed the yarn Y therebetween. Twists formed by the false twister 6 are propagated up to the first feed roller 3 and heat-set by the primary heater 4. That is, the upstream side of the false twister 6 is a twisting side and the downstream side thereof is an untwisting side.

In such false twister, the tension on the untwisting side exerts an important influence on the quality or physical properties (expansion and contraction, dyeability, etc.) of yarn, so various proposals have been made for controlling the contact pressure of belts so as to maintain the untwisting tension at a certain constant value.

In the conventional false twister, however, the construction for controlling the contact pressure of belts is complicated, thus resulting in increase of cost.

SUMMARY OF THE INVENTION

Accordingly, it is the object of the present invention to provide a false twister having a simple construction for controlling the belt contact pressure and so capable of attaining the reduction of cost and to provide a management method in such a false twister.

According to the present invention, for achieving the above-mentioned object, there is provided a false twister which nips yarn between crossed belts and imparts twist and feed to the yarn, the false twister including a sensor for detecting an untwisting tension of the yarn portion located downstream of the belts, and controlling means for making the untwisting tension constant in accordance with a detected signal provided from the sensor. The controlling means may be constructed by a cylinder for adjusting the contact pressure of the belts, valves for supplying an upper-limit air pressure and a lower-limit air pressure, respectively, to the cylinder, and a controller for opening or closing the valves.

According to the above construction, when the untwisting tension detected by the sensor is larger than a preset value for example, the controller opens the upper-limit air pressure supplying valve to increase the belt contact pressure, while when such detected untwisting tension is smaller than the preset value, the controller opens the lower-limit air pressure supplying valve to decrease the contact pressure. Since the yarn feed rate ismproportional to the belt contact pressure, the untwisting tension is maintained at a constant value (the preset value) by the above control. Thus, since this is attained by the provision of two valves, the construction required is simple and hence the reduction of cost can be attained.

Furthermore, according to the present invention, in a method for producing a false-twist yarn package by imparting twists to a yarn using a false twister and then taking up the thus-twisted yarn as a package using a take-up means, an untwisting tension of a yarn located downstream of the false twister is detected using a sensor and the quality of the package, processing condition of the false twister and etc. are judged on the basis of the result of the detection made by the sensor.

DETAILED DESCRIPTION OF PREFERRED EMBODIMENTS

A first embodiment of the present invention will be described in detail below with reference to the accompanying drawings.

Figure 1:
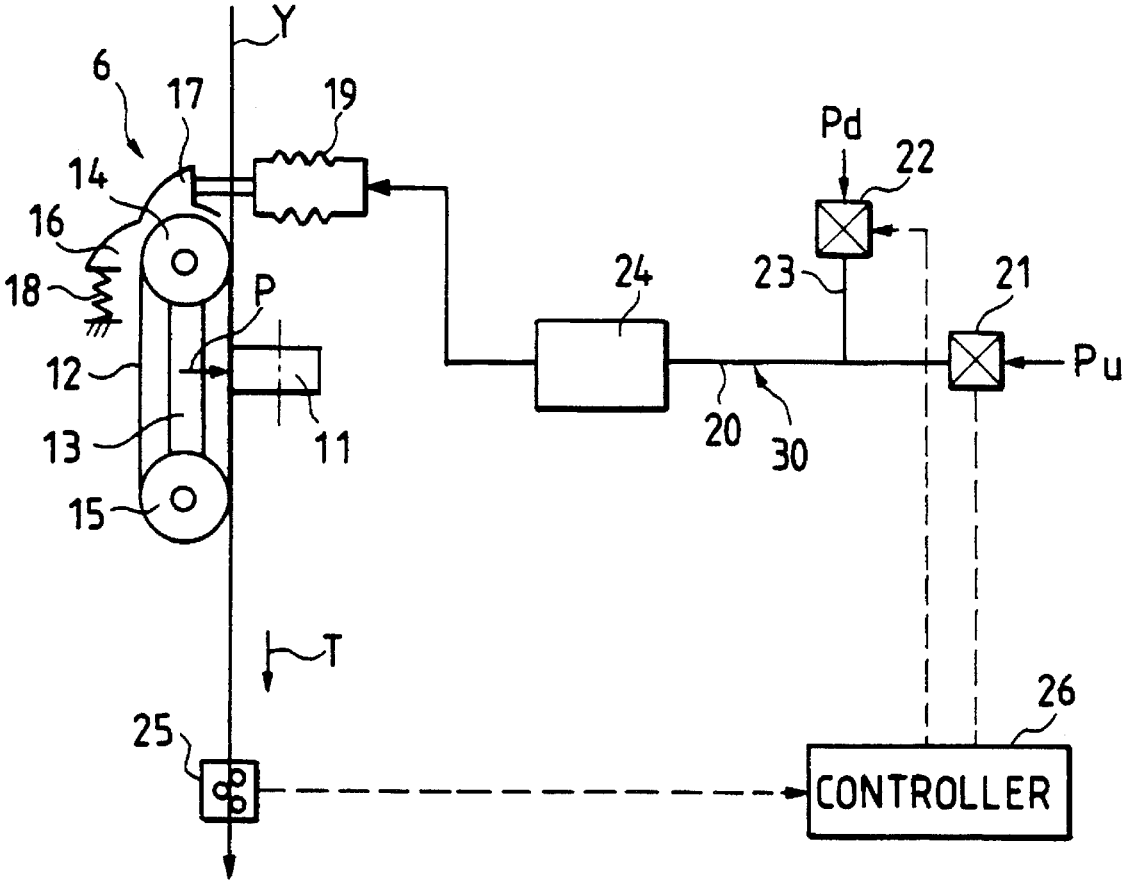
FIG. 1 is a diagram showing a construction of a false twister according to a first embodiment of the present invention.

In FIG. 1, the reference numeral 6 denotes a false twister used in a drawing and false-twisting machine. The false twister 6 is provided with a pair of endless belts 11 and 12 intersected with each other which nip yarn Y and impart twist and feed to the yarn. The belts 11 and 12 are each stretched between a driving pulley 14 and a driven pulley 15 which are supported a frame 13. One belt 11 (the right-hand belt in the same figure) is fixed at its position, while the other belt 12 is pivotable to adjust a contact pressure for the fixed belt 11, using the same axis as that of the driving pulley 14 as fulcrum.

Two levers 16 and 17 are mounted on the above pivotal fulcrum, and a spring 18 for moving the pivotable belt 12 away from the fixed-side belt 11 is in abutment with one lever 16, while in abutment with the other lever 17 is a bellows 19 serving as a cylinder for urging the pivotable belt 12 to the fixed-side belt 11 against the biasing force of the spring 18. To the bellows 19 are connected both a valve 21 (hereinafter referred to as the "first valve") for the supply of an upper-limit air pressure Pu through an air pressure supply pipe 20 and a valve 22 ("second valve") hereinafter) for the supply of a lower-limit air pressure Pd through the pipe 20. The second valve 22 is mounted to a branch pipe 23 which is branched from the air pressure supply pipe 20 in a downstream position with respect to the first valve 21. The air pressure supply pipe 20 is connected to an air pressure source (not shown) which is a supply source of the upper-limit air pressure as main pressure, while to the branch pipe 23 is supplied the lower-limit air pressure Pd having a predetermined value reduced from the main pressure.

The upper-limit air pressure Pu provides a maximum contact pressure not causing wear of the belts 11 and 12, while the lower-limit air pressure Pd provides a minimum contact pressure not causing slip of those belts. In order to mitigate an abrupt change in pressure caused by opening or closing of the first and second valves 21, 22, these valves are each provided with an orifice (not shown), and small pressure tank 24 is provided in the air pressure supply pipe 20. Alternatively, an orifice may be formed in an intermediate position (the position indicated at 30 in FIG. 1) of the air pressure supply pipe 20.

Figure 2:
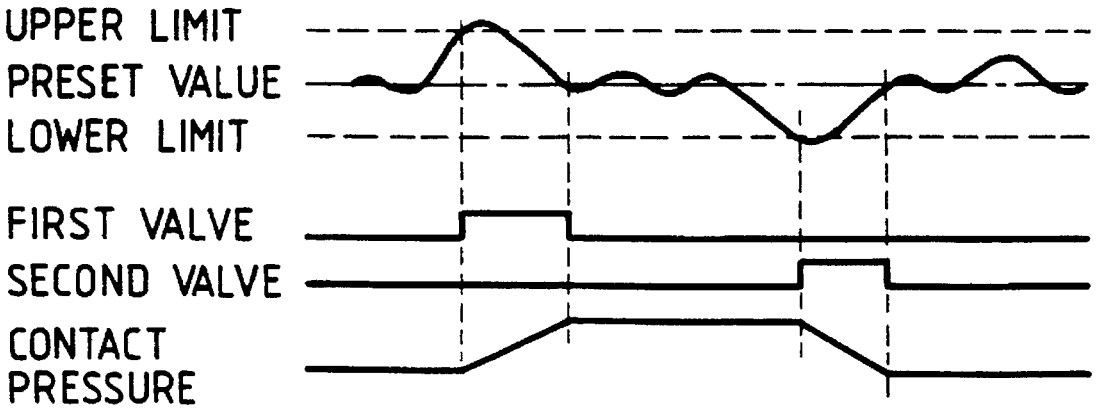
FIG. 2 is a diagram showing a relation between untwisting tension and control of a contact pressure in the first embodiment.

In the yarn path downstream of the belts 11 and 12 there is disposed a sensor 25 for detecting an untwisting tension T, and a detected signal from the sensor 25 is input in a controller 26. With respect to a preset value (target value) of the untwisting tension there are set an upper limit and a lower limit within a predetermined range as shown in FIG. 2 and the controller 26 is constructed so that when the untwisting tension exceeds the upper limit the controller opens the first valve 21 (the second valve 22 is closed) until the preset value is reached, while when the untwisting tension exceeds the lower limit the controller opens the second valve 22 (the first valve 21 is closed) until the preset value is reached. According to this construction, the contact pressure P of the belts 11 and 12 is controlled to maintain the untwisting tension T at a constant value (preset value).

In the false twister 6 constructed as above, when the untwisting tension T detected by the sensor 25 exceeds the preset value, that is, when it exceeds the upper limit, the controller 26 opens the first valve 21. Consequently, the contact pressure P of the belts 11 and 12 is increased by the bellows 19 on which is exerted the upper-limit air pressure Pu and the untwisting tension T decreases because the feed rate of the yarn Y is proportional to the belt contact pressure P. And when the untwisting tension T reaches the preset value, the first valve 21 is enclosed and the contact pressure of the belts 11 and 12 is kept as it is.

Conversely, when the untwisting tension T detected by the sensor 25 has become lower than the preset value, that is, when it has become lower than the lower limit, the controller 26 opens the second valve 22, so that the contact pressure P of the belts 11 and 12 is decreased by the bellows 19 on which is exerted the lower-limit air pressure Pd and the untwisting tension T increases. Then, when the untwisting tension T reaches the preset value, the second valve 22 is closed and the contact pressure of the belts 11 and 12 is kept as it is. In this way the untwisting tension is maintained at a constant value (preset value). Thus, the contact pressure P of the belts 11 and 12 can be controlled by merely controlling the two valves which are the first and second valves 21, 22, so that the construction is simplified and the reduction of cost can be attained.

In the above embodiment, a pressure release valve may be disposed in the air pressure supply pipe 20 in a position downstream of the first valve 21 so that the pressure release valve is opened when the breakage of yarn is detected by the sensor 25 to render the contact pressure P of the belts 11 and 12 zero.

According to the present invention, as set forth above, since the untwisting tension can be kept constant by merely controlling two valves one of which is for the upper limit and the other for the lower limit, the construction is simple and the reduction of cost can be attained.

A second embodiment of the present invention for achieving the object of the invention will be described below.

A false twister according to this second embodiment, which nips yarn between crossed belts and imparts twist and feed to the yarn, includes a motor for providing a contact pressure to the belts from a screw feed portion through a spring, a sensor for detecting an untwisting tension of the yarn portion located downstream of the belts, and a controller which controls the motor for forward or reverse rotation to keep the untwisting tension constant in accordance with a detected signal provided from the sensor.

According to the above construction, when the untwisting tension detected by the sensor exceeds the preset value, the controller causes the motor to rotate in the forward direction through the screw feed portion and the spring to increase the belt contact pressure, while when such untwisting tension has become lower than the preset value, the controller causes the motor to rotate in the reverse direction to decrease the belt contact pressure. Since the yarn feed rate is proportional to the belt contact pressure, the untwisting tension is maintained at a constant value (preset value) by the above control. Thus, the contact pressure control can be effected by only controlling the motor, so that a simple construction iS attained and the reduction of cost can be made. Further, a smooth and delicate control can be effected because the adjustment of the contact pressure is made through the screw feed portion and the spring.

The second embodiment of the present invention will be described in detail below with reference to the accompanying drawings.

Figure 3:
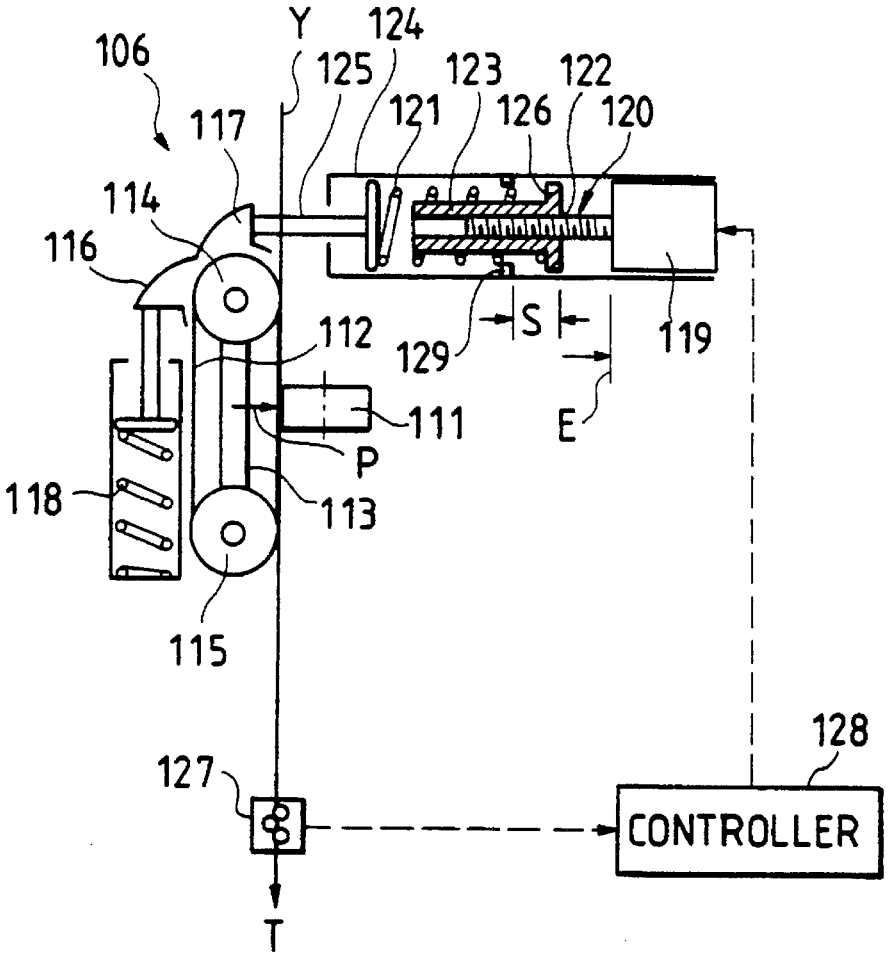
FIG. 3 is a diagram showing a construction of a false twister according to a second embodiment of the present invention.

In FIG. 3, the numeral 106 denotes a false twister used in a drawing and false-twisting machine. The false twister 106 is provided with a pair of crossed endless belts 111 and 112 which nip yarn Y and impart twist and feed to the yarn. The belts 111 and 112 are each stretched between a driving pulley 114 and a driven pulley 115 which are supported by a frame 113. One belt 111 (the right-hand belt in the same figure) is fixed at its position, while the other belt 112 is pivotable to adjust a contact pressure for the fixed belt 111, using the same axis as that of the driving pulley 114 as fulcrum.

Two levers 116 and 117 are mounted on the above pivotal fulcrum. A spring 118 for urging the pivotable belt 112 away from the fixed-side belt 111 is in abutment with one belt 116, while a screw feed portion 120 having a motor (.an electric motor capable of rotating forward and reverse) 119 for urging the pivotable belt 112 to the fixed-side belt 111 against the biasing force of the spring 118 and thereby adjusting the contact pressure P is in abutment with the other lever 117 through a spring 121.

The screw feed portion 120 is mainly composed of a screw shaft 122 connected to the rotating shaft of the motor 119 and a moving member 123 which is threadedly engaged with the screw shaft 122 and is moved back and forth by forward and reverse rotations of the screw shaft. The moving member 123 is received in a cylinder 124 while its rotation is restricted. In the front end portion of the cylinder 124 is received a push rod 125 which is in abutment with the lever 117. The rear end portion of the moving member 123 is formed with a flange 126, with the spring 121 being interposed between the flange 126 and the push rod 125.

Figure 4:
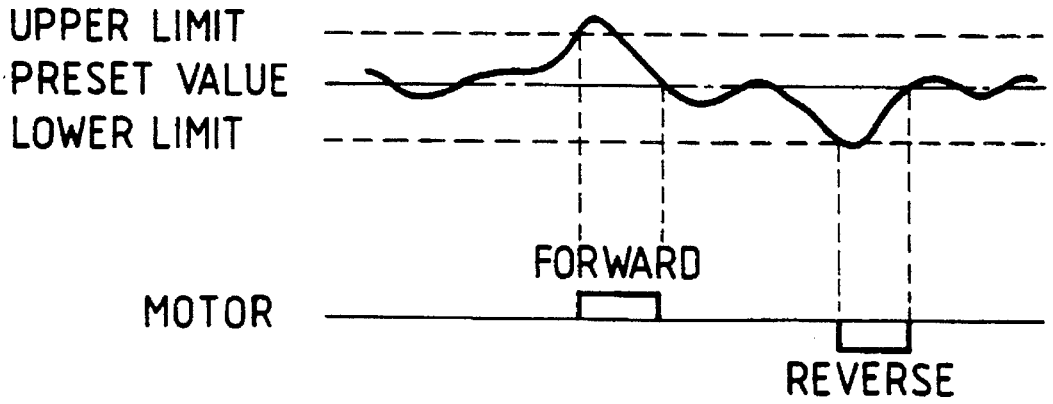
FIG. 4 is a diagram showing a relation between untwisting tension and control of a contact pressure in the second embodiment.

A sensor 127 for detecting an untwisting tension T of the yarn Y is provided along the yarn path downstream of the belts 111 and 112, and a signal detected by the sensor 127 is input in a controller 128. As shown in FIG. 4, the controller 128 sets an upper limit and a lower limit of a predetermined range in a preset value (target value) of the untwisting tension, and is so constructed as when the untwisting tension exceeds the upper limit the controller rotates the motor 119 in forward direction (in an advancing direction of the moving member 123) until the preset value is reached, while when the untwisting tension exceeds the lower limit the controller rotates the motor 119 in reverse direction (in a retracting direction of the moving member 123) until the preset value is reached. According to the above construction, the contact pressure P of the belts 111 and 12 is controlled and the untwisting tension is maintained at a constant value (preset value).

Within the cylinder 124 is provided a stopper 129 for restricting the foremost position of the moving member 123. For controlling the contact pressure P, the moving member 123is moved within a predetermined range (control range) S behind the stopper 129. The controller 128 is constructed so that when the breakage of yarn is detected through a sensor 127, the controller rotates the motor 119in the reverse direction to move the moving member 123 back to its rearmost position E.

In the false twister 106 constructed as above, when the untwisting tension T detected by the sensor 127 exceeds the preset value, that is, when it exceeds the upper limit, the controller 128 causes the motor 119 to rotate in the forward direction, so that the moving member 123 is moved forward by means of the screw feed portion 120 and the lever 117 is pushed through the spring 121 and the push rod 125. Consequently, the contact pressure P of the belts 111 and 112 increases and the untwisting tension T decreases because the yarn feed rate is proportional to the contact pressure P. When the untwisting tension T reaches the preset value, the rotation of the motor 119 is stopped and the contact pressure of the belts 111 and 112 is kept as it is.

Conversely, when the untwisting tension T detected by the sensor 127 has become lower than the preset value, that is, when it has become lower than the lower limit, the controller 128 rotates the motor 119 in the reverse direction. Consequently, the moving member 123 is moved backward, so that the contact pressure P of the belts 111 and 112 decreases and the untwisting tension T increases. When the untwisting tension T reaches the preset value, the rotation of the motor 119 is stopped and the contact pressure of the belts 111 and 112 is kept as it is. In this way the untwisting tension is maintained at a constant value (preset value). Thus, since the control of the belt contact pressure P can be done by merely controlling the motor 119, the construction is simple and the reduction of cost can be attained. Further, a smooth and delicate control can be effected because the adjustment of the contact pressure P is made by the screw feed portion 120 through the spring 121.

On the other hand, in the event of yarn breakage, the moving member 123 is moved back to its foremost position E, so that the pivotable belt 112 is moved away from the fixed belt 111 to release the contact pressure.

According to the second embodiment, as set forth above, since the control of the belt contact pressure can be done by merely controlling the motor, the construction is simple and the reduction of cost can be attained. Further, since the adjustment of the contact pressure is made by means of the screw feed portion through the spring, it is possible to effect a smooth and delicate control.

The following description is now provided about a third embodiment of the present invention capable of improving the quality of false-twist yarn in a simple construction.

According to the third embodiment there are used a nip twister which nips yarn between crossed belts and impart twist and feed to the yarn, a drive unit for driving the nip twister, a sensor for detecting an untwisting tension of the yarn portion located downstream of the belts, and a controller for controlling the drive unit to adjust the travelling speed of the belts so as to make the untwisting tension constant in accordance with a detected signal provided from the sensor.

According to the above construction, when the untwisting tension detected by the sensor exceeds a preset value the controller controls the drive unit to increase the travelling speed of the belts, thereby decreasing the untwisting tension, while when such untwisting tension has become lower than the preset value, the travelling speed of the belts is decreased to increase the untwisting tension, thereby maintaining the untwisting tension at a constant value to stabilize the quality.

The third embodiment of the present invention will be described in detail below with reference to the accompanying drawings.

Figure 6:
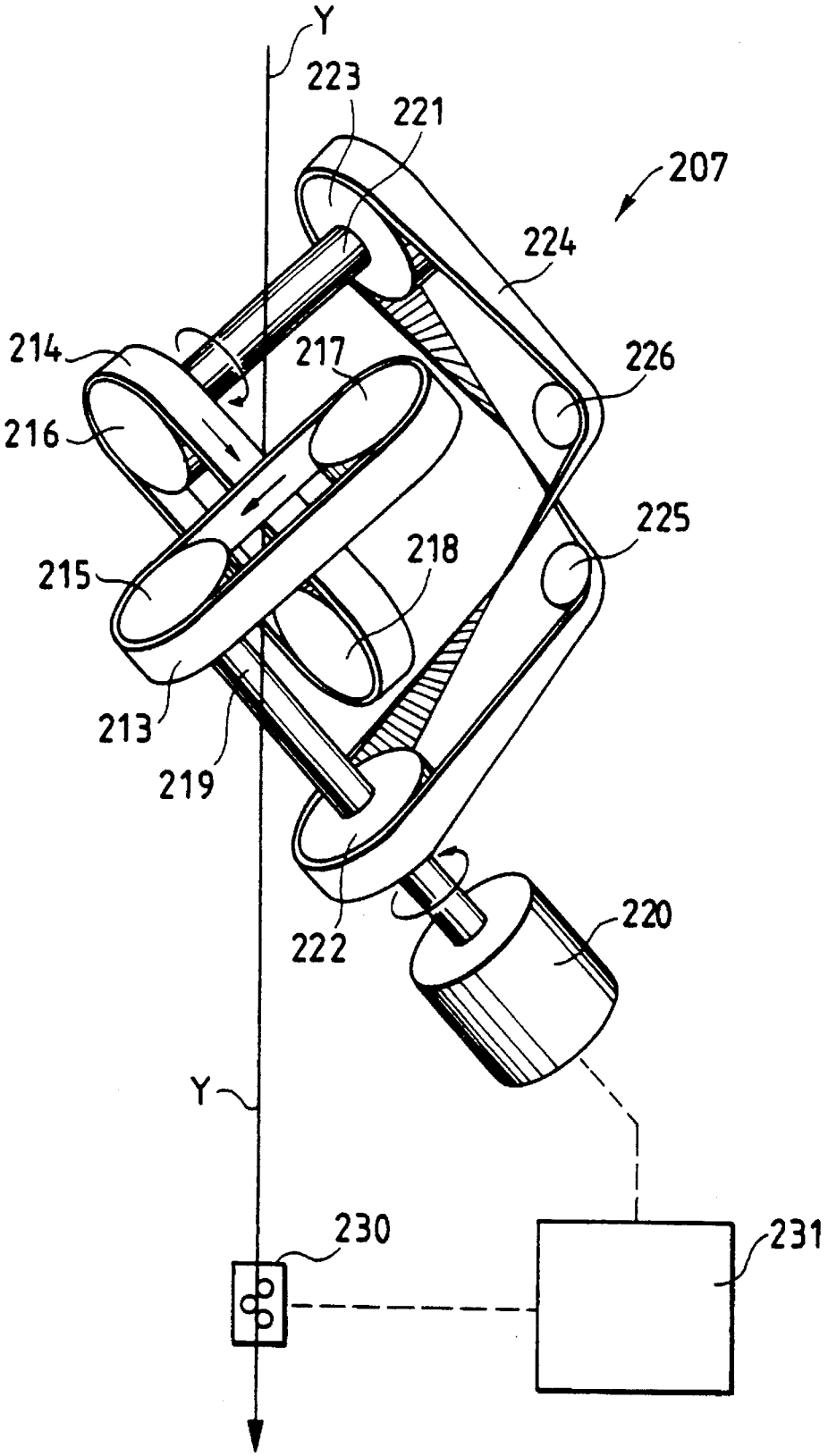
FIG. 6 is a diagram showing a construction of a false twister according to a third embodiment of the present invention.

In FIG. 6, the numeral 207 denotes a nip twister used in a drawing and false-twisting machine. The nip twister 207 is provided with a pair of crossed endless belts 213 and 214 which nip, twist and feed yarn Y. The belts 213 and 214 are stretched between driving pulleys 215, 216 and driven pulleys 217, 218 which are supported by a frame (not shown). A driving shaft 219 of the driving pulley 215 for one belt 213 is connected to a drive unit 220 which is a motor, while a driven shaft 221 fo the driving pulley 216 for the other belt 214 is driven in interlock with the driving shaft 219, so that the belts 213 and 214 are moved in the respective arrowed directions in the figure. More specifically, toothed pulleys 222 and 223 are mounted on the driving shaft 219 and the driven shaft 221, respectively, and a timing belt 224 is passed around both pulleys 222 and 223 in an approximately 90° -bent and crossed state, so that the driving shaft 219 transmits its arrowed rotation in the figure to the driven shaft 221 through the pulleys 222,223 and the timing belt 224 to rotate the driven shaft in its arrowed direction in the figure. On the going side and return side of the timing belt 224 there are disposed idlers 225 and 226 which guide the belt in a bent state while allowing torsion to occur.

The belt 213 on the driving side connected to the drive unit 220 is fixed at its position, while the belt 214 on the driven side is pivotable through the driven pulley 218 using the driven shaft 221 as fulcrum, whereby the Contact pressure for the driving-side belt 213 can be adjusted.

In the yarn path downstream of the belts 213 and 214 there is disposed a sensor 230 for detecting an untwisting tension T of yarn Y, and a detected signal provided from the sensor 230 is fed to a controller 231. The controller 231 is constituted by an inverter of an output frequency variable type so that the rotating speed of the drive unit 220 can be changed.

In accordance with a detected value provided from the sensor 230 the controller 231 controls the rotation of the drive unit 220 so that the untwisting tension T is equal to a preset value (target value), thereby controlling the travelling speed of the belts 213 and 214.

Figure 7:
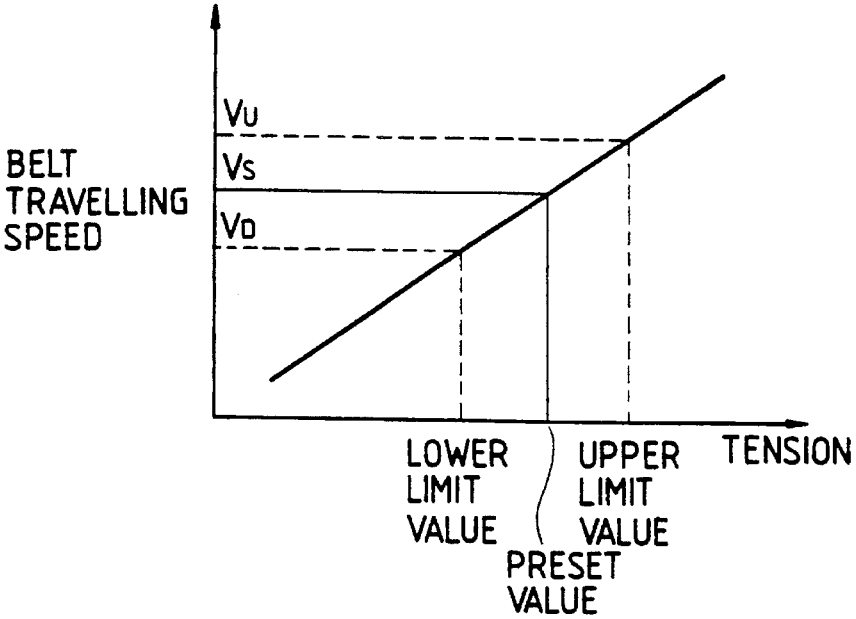
FIG. 7 is a diagram showing a relation between untwisting tension and belt speed.

The operation of this embodiment will be described below. The untwisting tension T and the travelling speed of the belts 213, 214 are approximately proportional to each other, as shown in FIG. 7, and a belt travelling speed VS relative to the target value is preset on the basis of FIG. 7. As illustrated in the same figure, in order that the untwisting tension becomes equal to the target value, the controller 231 controls the number of revolutions of the drive unit 220 to drive the belts 213 and 214 at the preset travelling speed VS. In this case, the untwisting tension varies due to a change in the draw ratio of yarn Y, a change in temperature of a heater, etc. Such a change in the untwisting tension is detected by the sensor 230 and if the untwisting tension is higher than the preset value, the controller increases the number of revolutions of the drive unit to increase the belt travelling speed in accordance with the map of FIG. 7, while when the untwisting tension is lower than the preset value, the controller decreases the number of revolutions of the drive unit to decrease the belt travelling speed.

Thus, when the untwisting tension is higher than the preset value, if the belt travelling speed is increased, the yarn Y feed rate can be so much increased, whereby the untwisting tension can be decreased. Conversely, when the untwisting tension is lower than the preset value, the yarn feed rate is decreased by decreasing the belt travelling speed, thus permitting the untwisting tension to be increased.

Accordingly, by adjusting the belt travelling speed so as to give constant values detected by the sensor 230, there can be obtained a take-up package of uniform quality.

Actually, since the untwisting tension can be changed freely by changing the belt travelling speed, it is possible to keep the untwisting tension constant even when there is something abnormal in the apparatus. Therefore, as shown in FIG. 7, an upper-limit value and a lower-limit value are set with respect to the preset value and correspondingly thereto there are also set an upper-limit value VU and a lower-limit value VD of the belt travelling speed, then when the untwisting tension detected by the sensor 230 reaches the upper-limit value and the belt travelling speed reaches the upper-limit value VU, or when the untwisting tension reaches the lower-limit value and the belt travelling speed reaches the lower-limit value VD, the controller 231 judges that this state is abnormal and stops the operation of the false twister.

Although in the above embodiment the belt travelling speed is changed almost continuously by means of an inverter, control may be made so that the number of revolutions is changed stepwise by tap change of the motor winding as the drive unit.

According to the third embodiment, as set forth above, an untwisting tension is detected and the belt travelling speed of the nip twister is controlled so that the detected value is equal to the preset value, whereby the quality of the false-twist yarn can be improved.

The false twister for controlling the untwisting tension constant has been described above.

However, there is the problem that even if the untwisting tension is controlled constant, it is not always possible to produce a false-twist yarn of stable quality. Particularly in recent years, a partially drawn yarn (POY, Polyethylene Oriented Yarn) has been used as the feed yarn, and in the case where the draw ratio is not satisfactory, there is no guarantee of attaining uniform quality even if untwisting tension is controlled constant. Also under different operating conditions, for example when the heater disposed upstream of the nip twister does not function properly or when the belts of the nip twister are worn out to an abnormal extent, it is no longer possible to guarantee the quality.

In view of the point just mentioned above the following description is now provided about a method and apparatus which permit production of a false-twist yarn of stable quality.

In order to achieve the above object there is provided a controller for the false twister which is for imparting false twists to yarn, the controller having a sensor for detecting an untwisting tension of the yarn portion located downstream of the false twister and an untwisting tension control means for controlling the false twister in such a manner that the result of the detection made by the sensor falls under a predetermined range, a control range for the false twister in the untwisting tension control means being limited.

In this case, it is preferable that the control range for the false twister be capable of being set. For example, as the false twister there is used a nip type false twister which nips yarn between a pair of nip members and thereby imparts false twists and feed to yarn. For example there is used a nip twister using crossed belts as the paired nip members. In this belt type nip twister, a contact pressure between the belts or the belt travelling speed is controlled by the untwisting tension control means so that the result of the detection made by the sensor falls under a predetermined range, and the control range for such contact pressure or belt travelling speed is limited. For example, to limit the control range for the contact pressure between the belts, there are provided a cylinder for changing the belt contact pressure and a contact pressure control means comprising two valves which are a valve for supplying an upper-limit air pressure to the cylinder and a valve for supplying a lower-limit air pressure to the cylinder.

According to the above construction, the false twister is controlled by the untwisting tension control means so that the untwisting tension detected by the sensor falls under the predetermined range. Since the control range for the false twister is limited, when the fed yarn is defective or when there is something abnormal in the false twister for example, it is no longer possible to control the untwisting tension in the false twister and the untwisting tension detected will be outside the predetermined range. This means that the fed yarn is defective, or the false twister for example is out of order, or the yarn after processing is defective. Therefore, by monitoring the untwisting tension, it is made possible to easily find out an abnormal condition of the false twister or a defective yarn.

According to the management method for this false twister, in order to permit the production of a false-twist yarn having a stable quality, an untwisting tension of the yarn portion located downstream of the false twister is detected by means of a sensor, then the false twister is controlled so that the untwisting tension falls under a target range, and it is judged that the operating condition is abnormal in the case where the untwisting tension exceeds a tolerance limit range even under such control for the false twister.

The above tolerance limit range is set to a range exceeding the target range.

Thus, according to the above construction, the untwisting tension is detected by the sensor and it is judged to be abnormal when it does not fall under the target range but exceeds the tolerance limit value even under the control for the false twister, whereby the discovery of a trouble of the false twister or of a defective yarn can be done easily.

According to the present invention, in order to permit judging whether the package produced is good or bad and also permit sorting and grading of such package, in a false-twist yarn package producing method involving twisting yarn in a false twister and winding up the so-twisted yarn as package using a take-up unit, there is provided a grading method for such false-twist yarn package, which method comprises detecting an untwisting tension of the yarn portion located downstream of the false twister, judging whether the package is good or bad on the basis of the result of the detection, and grading the package on the basis of the said judgment at the time of conveyance of the package, and there is provided a false-twist yarn package grading method comprising detecting an untwisting tension of the yarn portion located downstream of the false twister, using a sensor, controlling the false twister in such a manner that the result of the detection falls under a target range, limiting the control range for the false twister, and judging the quality of the package on the basis of the result of the detection made by the sensor.

In this case, it is preferable that a tolerance limit range be set to a range exceeding the target range and that the untwisting tension be judged abnormal in the case where it exceeds the said range.

According to the above construction, in winding up the twisted yarn as package using each take-up unit, the untwisting tension is detected by the sensor and the yarn quality (whether a defect is present or not, etc.) is judged on the basis of the detected data, whereby such packages can be sorted easily during conveyance on the basis of the data obtained.

According to the present invention, moreover, in order to permit easy discovery of an abnormal spindle out of plural spindles in a false twist machine and thereby permit maintaining the yarn quality at a high level, in connection with a false twist machine provided with a false twister for each of plural spindles and also provided with a sensor for detecting an untwisting tension of the yarn portion located downstream of the false twister, there is provided a management method for the false twister, wherein when the rate of the untwisting tension exceeding a preset range is higher than a predetermined rate in a certain spindle, this spindle is judged to be abnormal.

According to the above construction, if the yarn fed to a certain spindle is defective or that spindle per se is defective, there often occurs a condition of the untwisting tension exceeding the preset range at that spindle. In this case, the spindle concerned is judged to be abnormal.

Further, in order to permit judging whether processing conditions are appropriate or not in the production of a false-twist yarn, in connection with a false twist machine provided with a false twister for each of plural spindles and also provided with a sensor for detecting an untwisting tension of the yarn portion located downstream of the false twister, there is provided a processing condition judging method comprising controlling the false twister so that the untwisting tension detected by the sensor at each spindle falls under a target range and judging that the processing conditions are inappropriate in the case where the number of spindles at which the untwisting tension exceeds the target range is larger than a predetermined number even under such control for the false twister.

According to the above construction, even if the false twister is controlled at each spindle to adjust the untwisting tension, if the processing conditions are not properly followed, the untwisting tension will largely exceed the target range at many spindles. Therefore, in the case where there are a predetermined number or more of such spindles, it can be judged that the processing conditions are inappropriate.

An embodiment of the present invention will be described in detail below with reference to the accompanying drawings.

Figure 8:
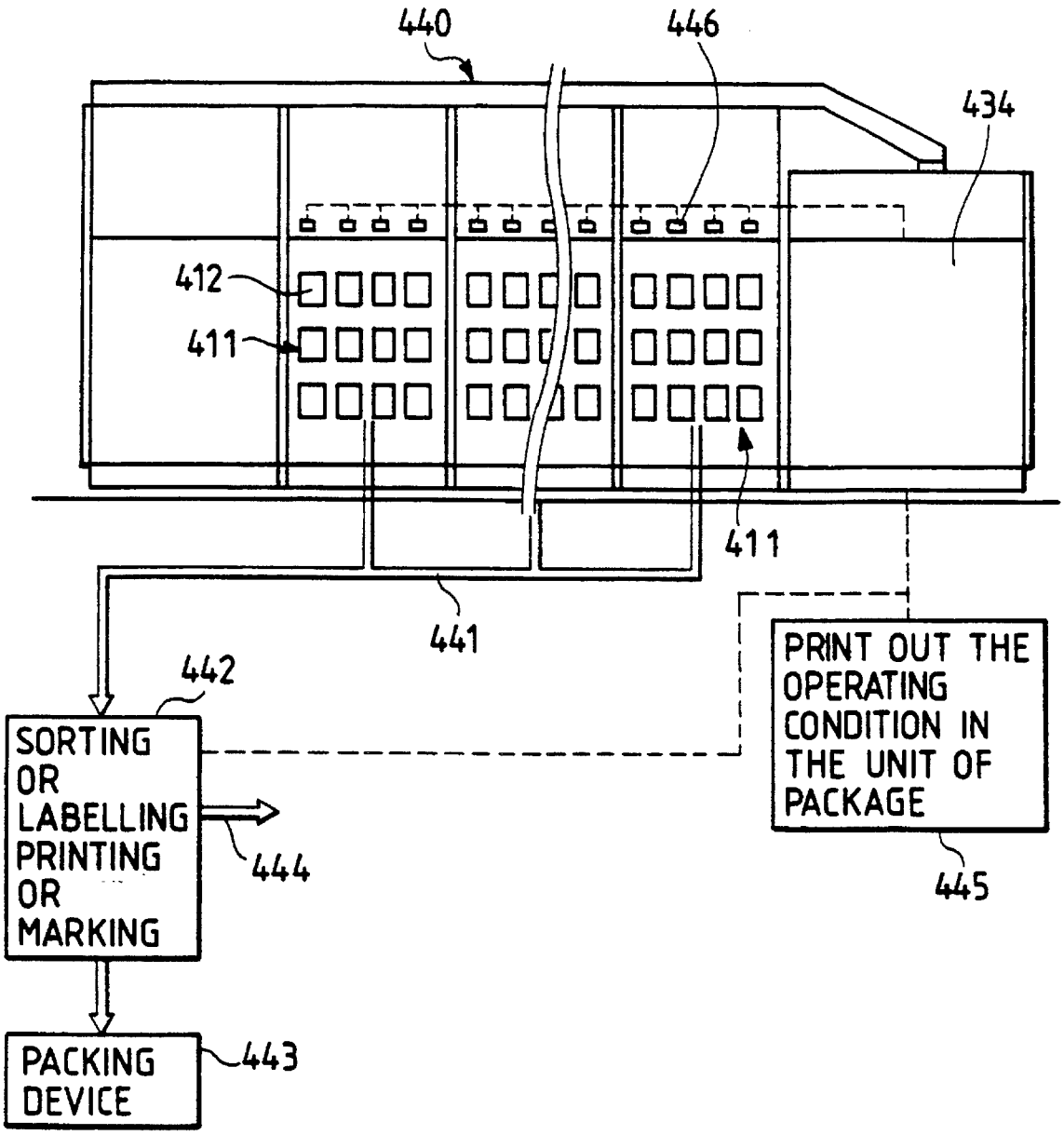
FIG. 8 is a schematic diagram showing the whole of a false twist machine.

Referring to FIG. 8, there is illustrated an entire construction of a false twist machine 440. In the same figure, a large number of take-up units 411 each for winding up false-twisted yarn as package 412 are arranged horizontally in three vertical stages. The take-up units 411 are controlled their operation by means of a controller 434 which will be described later. The package 412 after the winding-up of yarn by each takeup unit 411 is subjected to doffing and thereafter delivered to a conveyance line 441 although the details of this point are omitted. In this case, information regarding at which spindles the packages on the conveyance line 441 have been produced is stored in the controller 434 in the order of conveyance of the packages, and also stored therein are package discriminating data which will be explained later. Upon arrival of each package 412 at a sorter 442, the sorter judges whether the package is good or bad and forms labelling and printing or marking for the package. Good package is allowed to flow to a packing device 443, while bad package is discharged to a line 444 for sorting. Whether the packages are good or bad is stored for each spindle and can be printed out in the unit of package or spindle, as indicated at 445.

Figure 9:
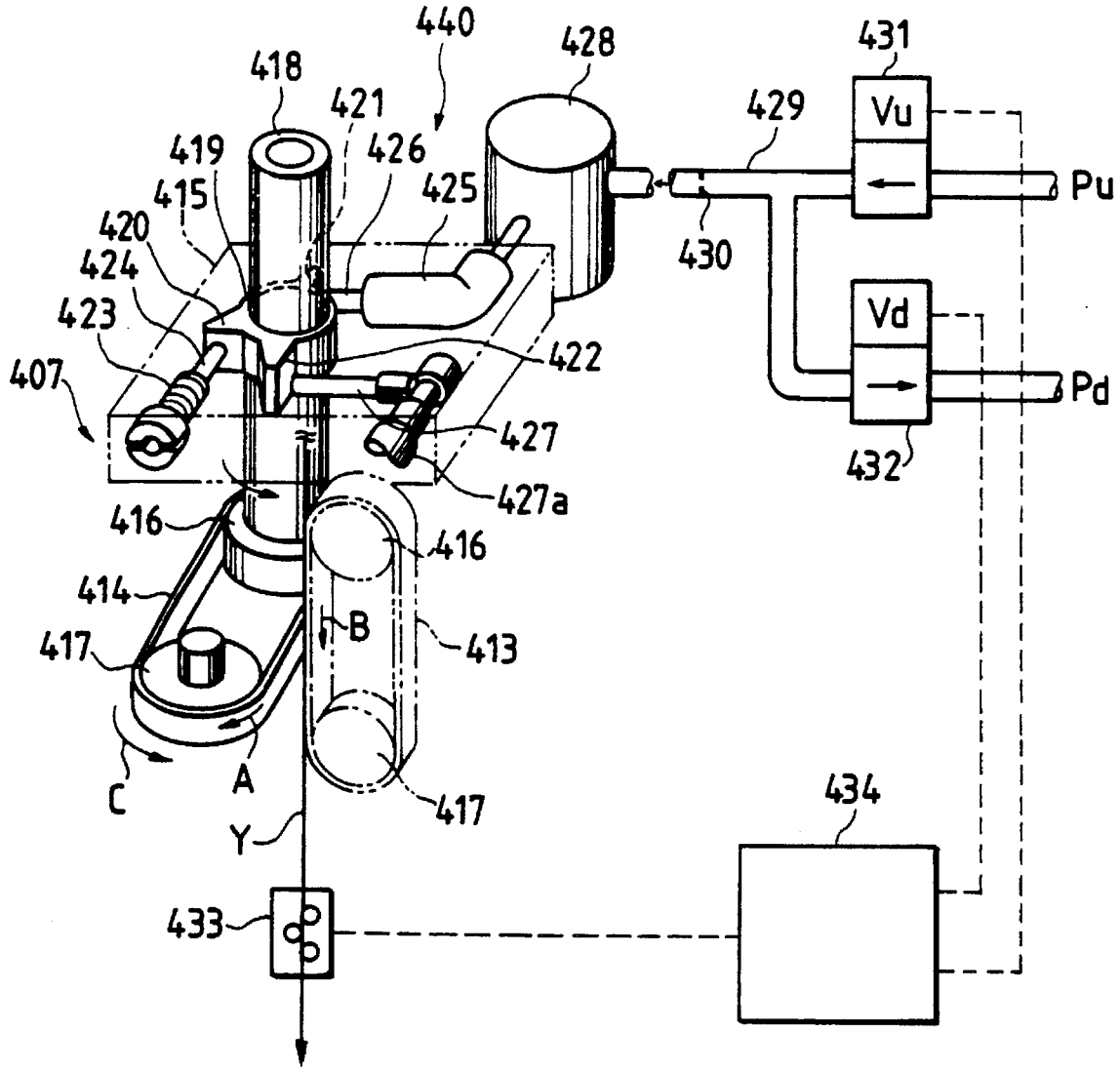
FIG. 9 is a diagram showing the details of a false twist portion illustrated in FIG. 8.

FIG. 9 shows the details of contact pressure adjustment made by a nip twister and the detection of an untwisting tension.

In FIG. 9, the numeral 407 denotes a nip twister (false twister) used in a drawing and false-twisting machine. The nip twister 407 is provided with a pair of crossed endless belts 413 and 414 which nip yarn Y and impart twist and feed to the yarn. The belts 413 and 414 are each stretched between a driving pulley 416 and a driven pulley 417 which are supported by a frame 415, and they are driven in the directions of arrows A and B, respectively. The belt 413 indicated by a dash-double dot line is fixed at its position, while the other belt 414 is supported pivotably using the same axis as that of the driving pulley 416 as fulcrum to adjust the contact pressure for the fixed-side belt 413. By a contact pressure adjusting means 440 comprising a cylinder 425 and valves 431, 432 which will be described later, the pivotable belt 414 is urged against the fixed-side belt 413 to adjust the contact pressure.

The driving pulley 416 and the driven pulley 417 are supported by a touch roller 418, which in turn is supported rotatably by the frame 415. By rotating the touch roller 418, the belt 414 is made pivotable in the direction of arrow C in the figure about the same axis as that of the driving pulley 416 as fulcrum.

Into the touch roller 418 is inserted a driving shaft (not shown), through which the driving pulley 416 is driven using a motor or the like. The touch roller 418 is supported rotatable by the frame 415 and a holder 419 is attached to the touch roller 418. The holder 419 has three lever portions 420, 421 and 422. A contact pressure adjusting pin 424 provided with a spring 423 for urging the pivotable belt 414 away from the fixed-side belt 413 is in abutment with the first lever portion 420, and a piston 426 of a cylinder 425 for urging the pivotable belt 414 to the fixed-side belt 413 against the biasing force of the spring 423 is in abutment with the second lever portion 421. Further, a stopper pin 427 for restricting a maximum pivotal position of the pivotable belt 414 is in abutment with the third lever portion 422. The spacing between the belts 413 and 414 can be opened large by turning a lever 427*a* connected to the stopper pin 427.

The cylinder 425 is connected to a reserve tank 428, and an air pressure supply pipe 429 is connected to the reserve tank 428. The air pressure supply pipe 429 is internally provided with orifices 430 of, say, 0.1 mm or so and is bifurcated on its upstream side. To one of the bifurcated branch pipes is connected a valve (hereinafter referred to as the "first valve") for the supply of an upper-limit air pressure Pu, while to the other branch pipe is connected a valve 432 ("second valve" hereinafter) for the supply of a lower-limit air pressure Pd. The upstream side of the first valve 431 is connected to an air pressure supply source, while that of the second valve 432 is either connected to an air pressure supply source separate from the said supply source or connected to the said supply source through a reducing valve or the like.

The upper- and lower-limit air pressures Pu, Pd are set according to the kind of yarn and the belt travelling speed as will be described later.

Downstream of the belts 413 and 414, a sensor 433 for detecting an untwisting tension T of yarn Y is disposed in the yarn path, and a detected signal provided from the sensor is fed to a controller 434.

A control range (target range) for the untwisting tension is inputted beforehand to the controller 434 according to operating conditions and the kind of POY. In this control range there are set upper- and lower-limit values with respect to the target value. The controller 434 is constructed so as to open the first valve 431. (the second valve 432 is closed) during a period in which the untwisting tension exceeds the upper limit value and open the second valve 432 (the first valve 431 is closed) during a period in which the untwisting tension is below the lower-limit value. According to this construction, the contact pressure of the belts 413 and 414 is controlled to maintain the untwisting tension T within the control range.

The numeral 427*a* in FIG. 9 denotes a handle, which is operated, for example, at the time of starting the false twist operation to create spacing from the pivotable belt 413 and thereby permit threading, etc.

The controller 434 and the contact pressure adjusting means 440 constitute an untwisting tension control means. The orifices 430 and the reserve tank 428 are provided for preventing the pulsation of air pressure and for preventing the hunting of an untwisting tension.

According to the above construction, the yarn Y fed by the nip twister 407 is taken up as package 412 (see FIG. 8) while its untwisting tension T is detected by the sensor 433, and the detected value is fed to the controller 434. A target value of the untwisting tension is inputted beforehand to the controller 434. Also, upper- and lower-limit values Tu, Td of the tension, which are in the control range relative to the target value To, are inputted to the controller 434. The contact pressure adjusting means 440 is controlled on the basis of the untwisting tension detected by the sensor 433 and the contact pressure of the belts 413, 414 is adjusted so that the untwisting tension is equal to the target value To.

Figure 10:
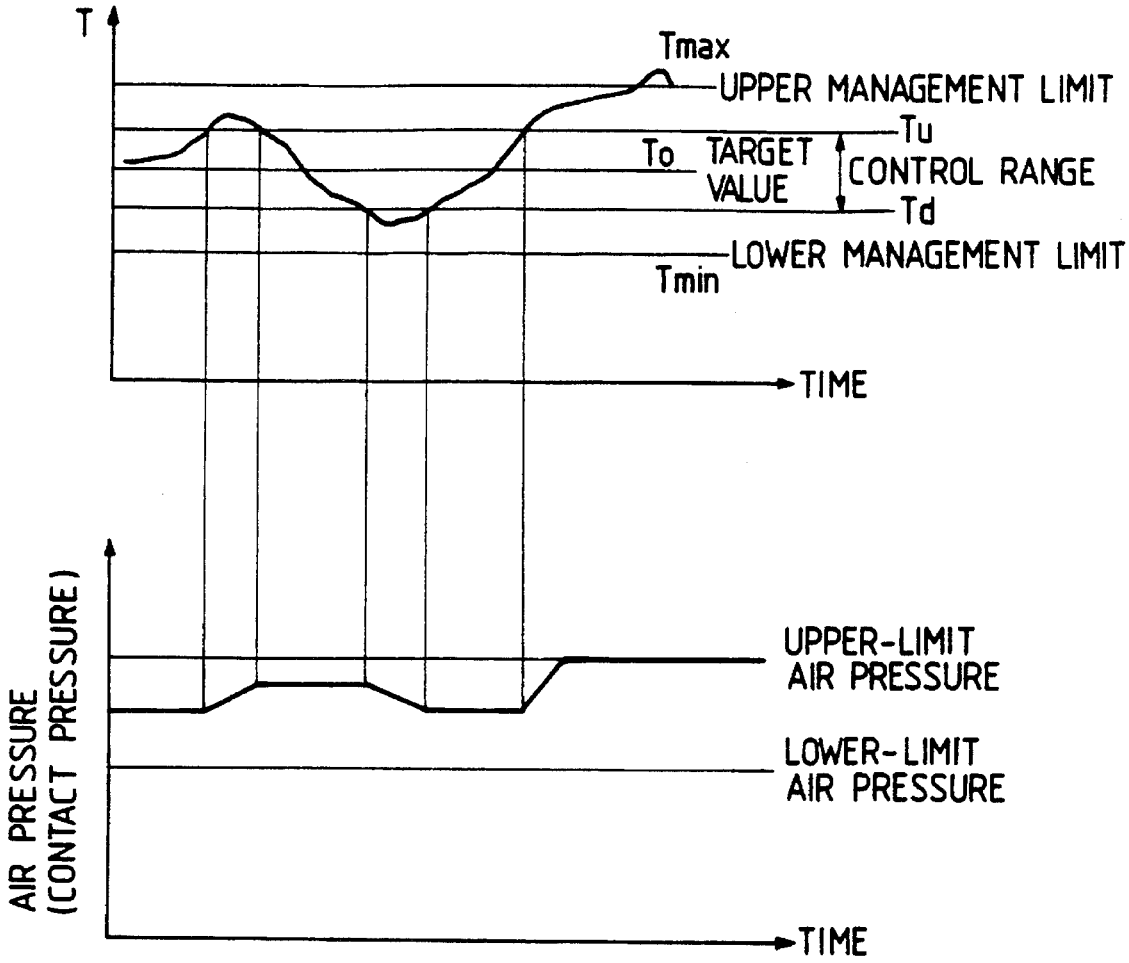
FIG. 10 is a diagram showing control of valves against changes of untwisting tension as well as changes of air pressure.

This point will be described below in more detail with reference to FIGS. 10 and 11.

Figure 11:
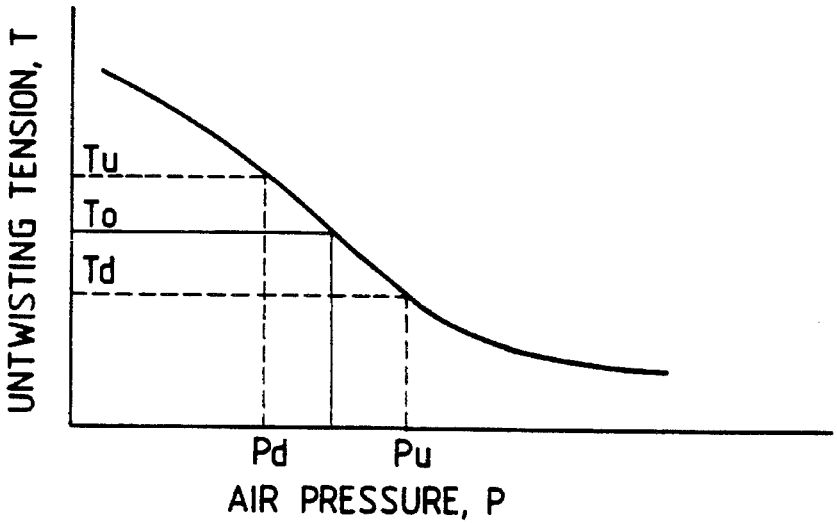
FIG. 11 is a diagram showing a relation between untwisting tension and air pressure.

FIG. 11 shows a relation between the air pressure P fed to the cylinder 425 and the untwisting tension T. As is seen from FIG. 11, the untwisting tension T lowers as the air pressure P increases. Therefore, an upper limit Tu and a lower limit Td of the tension permitting production in a stable quality are set relative to the target value To of the untwisting tension and thereafter a control range for the air pressure P is determined. More specifically, an upper-limit value Pu of the air pressure for the upper-limit value Tu of the untwisting tension is determined and there also is determined a lower-limit value Pd of the air pressure for the lower-limit value Td of the untwisting tension, then on the basis of the basis of the upper-and lower-limit values Pu, Pd thus determined, the air pressure to be supplied to the first valve 431 and that to the second valve 432 are set almost equal to the upper- and lower-limit values Pu, Pd, respectively.

In this way the upper- and lower-limit air pressures Pu, Pd which permit a proper tension control relative to the target value To of the untwisting tension can be fed to the valves 431 and 432, respectively. Also inputted to the controller 434 are an upper management limit Tmax and a lower management limit Tmin which are tolerance limit values outside the control range for the target value To.

Adjustment of the contact pressure is conducted in the following manner. As shown in FIGS. 9 and 10, while the untwisting tension T detected by the sensor 433 exceeds the upper-limit value Tu during false-twist operation, the first valve 431 is opened, whereupon the upper-limit air pressure Pu acts on the reserve tank 428 through the orifices 430. As a result, the pressure exerted on the cylinder 425 rises gradually and hence the contact pressure P of the belts 413 and 414 increases. With such increase of the contact pressure P, the yarn Y feed rate of the belts 413 and 414 becomes higher in proportion to the contact pressure, so that the untwisting tension T decreases. when the untwisting tension T becomes lower than the upper-limit value Tu and enters the control range, the first valve 431 is closed and the cylinder 425 maintains the pressure increased during that period, whereby the contact pressure of the belts 413 and 414 is kept as it is.

Conversely, while the untwisting tension T detected by the sensor 433 is below the lower-limit value Td, the controller 434 opens the second valve 432. As a result, the lower-limit air pressure Pd acts on the reserve tank 428 and the air pressure in the cylinder 425 drops. Consequently, the contact pressure P of the belts 413 and 414 decreases and the untwisting tension T increases. Then, when the untwisting tension T becomes higher than the lower-limit value Td and enters the control range, the second valve 432 is closed and the contact pressure of the belts 413 and 414 is kept as it is. In this way the untwisting tension T is maintained in the predetermined control range for the target value To.

However, in the event a feed package is a defective package or in the event of occurrence of a trouble on the drawing and false-twisting machine side, the untwisting tension detected by the sensor 433 no longer enters the control range even if the air pressure P is held at its upper limit Pu or lower limit Pd (the first valve 431 or the second valve 432 is kept open). More particularly, in the construction of this controller, the control range for the contact pressure between the belts 413 and 414 is limited to the range defined by both the upper- and lower-limit air pressures Pu, Pd, so in the case just mentioned above the untwisting tension T does not fall under the control range. According to this controller, moreover, when the untwisting tension exceeds the upper management limit Tmax or is lower than the lower management limit Tmin, that is, when the untwisting tension T cannot be adjusted to a value falling under the control range, it is judged to be abnormal. Thus, it is possible to find out an abnormal condition. Once this judgment is made, there issues a warning, or the yarn is cut. By cut of the yarn, the winding of a defective yarn is prevented and it is possible to produce a false-twist yarn of stable quality.

Once the judgment acknowledging such abnormal condition is made, the duration of the abnormal condition and how many times such abnormal condition occurred can be stored for each take-up package as data for judging whether the quality of that package is good or bad.

When the air pressure P is held at its upper- or lower-limit Pu or Pd (the first valve 431 or the second valve 432 remains open) and the untwisting tension T detected by the sensor 433 is outside the upper and lower management limits Tmax, Tmin, not falling under the control range, more concretely when such untwisting tension T exceeds the upper management limit Tmax beyond the upper limit Tu or when it is below the lower limit Td and lower than the lower management limit Tmin, that is, when it is impossible to let the untwisting tension T fall under the control range, the controller 434 judges that the untwisting tension is abnormal and that the take-up package concerned is defective. In this case, a defective yarn length is determined on the basis of the duration (yarn length) in which the untwisting tension is outside the upper and lower management limits Tmax, Tmin, the number of defects is determined on the basis of how many times the untwisting tension was outside such upper and lower limits, and the degree of each defect is determined on the basis of the defective yarn length and the number of times of defect occurrence. These are also conducted at the same time. The range of the upper and lower management limits Tmax, Tmin which are inputted to the controller 434 can be set freely according to the yarn fed or operating conditions. Also can be set a judgment value about the degree of defect. Further, even upon judgment acknowledging the presence of an abnormal condition, whether the yarn should be cut or warning should be provided may be decided on the basis of the result of judgment about the degree of the defect. In this case, once it is judged that the defect is serious, the yarn is cut and alarm or warning is given on a display unit 446 disposed for each take-up unit 411 (correspondingly to each spindle). Such yarn quality data are stored in the controller 434 for each package and the controller sorts packages on the basis of the package data. More specifically, liscrimination data of each package are stored in the controller 434, then the completion of the yarn winding operation for each package is followed by doffing, and each package is delivered to a conveyance line 441 as shown in FIG. 8. At this time, such discrimination data are transmitted to the sorter 442 successively in the order of conveyance of the packages, which sorter in turn performs sorting or labelling.

According to the construction of the present invention, moreover, when the rate of the untwisting tension T being unable to fall under the control range at a certain spindle, namely the rate of judging the operating condition to be abnormal, is higher than a predetermined value, the said spindle is judged to be an abnormal spindle and an alarm is given on the display unit 446 which is provided correspondingly for each spindle. For example, the judgment acknowledging an abnormal spindle is made on the basis of ① how many times such judgment has been made, ② how many times such judgment has been made within a predetermined time or per feed package, ③ the duration of such judgment within a predetermined time or per feed package, or ④ comparison between the number of times or duration of such judgment and a mean value at the other plural spindles. In the case where an abnormal condition of the untwisting tension often occurs at a certain spindle, this is because of a mechanical defect at that spindle or some defect involved in the feed of yarn at that spindle or inappropriate processing conditions which have been set. In the case of the last cause just mentioned, that is, in the case where the processing conditions which have been set are inappropriate, an abnormal condition of the untwisting tension often occurs also at other spindles. Thus, when an abnormal untwisting tension often occurs at a certain spindle and the rate of occurrence thereof is high at this spindle in comparison with a plurality of other spindles, this is because of a defect of the spindle in question or some defect in the feed of yarn at this spindle, so this spindle is judged to be an abnormal spindle. Therefore, the discovery of an abnormal spindle can be done easily by judging whether the rate of the untwisting tension exceeding the preset range is higher than a predetermined rate or not, as in the present invention. In the present invention, moreover, when the rate of the untwisting tension exceeding the preset range is still higher than the predetermined rate even after the change of yarn fed at a certain spindle (a certain abnormal spindle), it is judged that the spindle in question is a defective spindle. That a spindle is judged to be an abnormal spindle is because of some defect of the spindle itself or of the yarn fed. In the case where an abnormal condition of the untwisting tension often occurs even after the change of yarn fed, this has nothing to do with the feed of yarn, but means that the spindle itself is defective. Thus, the discovery of a defective spindle can be done easily by judging whether an abnormal condition of the untwisting tension still occurs even after the change of yarn fed.

On the other hand, when the processing conditions used are not appropriate, there occurs a phenomenon such that the untwisting tension T departs from the control range at many spindles. Therefore, judgment is made as to whether the number of spindles wherein the untwisting tension T is outside the control range exceeds a predetermined number or not. If the answer is affirmative, it is judged that the processing conditions used are inappropriate. In this case, such processing conditions as the draw ratio and the yarn travelling speed are changed to appropriate processing conditions so that the untwisting tension falls under the control range.

Thus, whether each package is good or bad can be judged and it is also possible to judge whether an abnormal spindle is present or not, further, the results of the judgment can be used as management data.

In the case of a defective package, the state of the defect can be judged and it is possible to grade it.

Moreover, since whether a package is good or bad can be judged and in the case of a defective package the state of the defect can be detected, it is easy to obtain a package of stable quality.

When it is judged that an abnormal condition is present, it is desirable to check whether the false twister is in an abnormal condition or POY is in such condition, then investigate and eliminate the cause.

The setting of upper and lower limits in the control range relative to the target value To can be changed freely according to operating conditions and untwisted yarn.

Although in the above embodiment the cylinder 425 and the valves 431, 432 are used as the contact pressure adjusting means 440, the untwisting tension may be adjusted by changing the travelling speed of the belts 413 and 414 of the nip twister 407 or by using any other suitable means. As the false twister there may be used a false twister other than the nip twister, e.g. friction false twister.

Further, the upper and lower management limits may be set in two stages, and in this case, an alarm is given when the untwisting tension has become higher or lower than the first upper or lower management limit, then the yarn is cut when the untwisting tension has become higher or lower than such upper or lower limit.

According to the present invention, as described above, since the control range for the false twister to control the untwisting tension is limited, it is possible to detect a trouble, etc. of the false twister and hence possible to obtain a false-twist yarn of stable quality.

Moreover, since the untwisting tension is detected by the sensor and is judged to be abnormal when it is outside the tolerance limit range, not falling under the target range, even after control for the false twister, there can be obtained a stable quality yarn.

Besides, in winding up the yarn as package by means of each take-up unit, the untwisting tension is detected by the sensor, then the quality of yarn is judged on the basis of the detected data, and on the basis of the resulting judgment data it is possible to sort packages easily during conveyance thereof.

Further, according to the present invention, an abnormal spindle, namely, a defective spindle itself or a spindle at which the yarn fed is defective, can be found out easily and so it is possible to prevent subsequent occurrence of a defective package.

Additionally, in the present invention, when the number of spindles at which the untwisting tension is outside the target range is larger than a predetermined number even if the false twister is controlled so as to let the untwisting tension fall under the target range at each spindle, it is judged that the processing conditions used are inappropriate, so it is possible to prevent a continuous production of defective yarn resulting from such inappropriate processing conditions.

The following description is now provided about a management method for a false twister which method permits easy judgment of a spindle requiring maintenance out of plural spindles of a false twist machine, for the guarantee of yarn quality.

According to this management method, in connection with a false twist machine provided with false twisters and sensors for detecting an untwisting tension of the yarn portion located downstream of the false twister, there is made judgment as to whether maintenance is necessary or not on the basis of changes with time of detected values provided from the sensors.

According to the above construction, as the stain of heater or the wear of belt becomes more conspicuous with the lapse of time, the untwisting tension also increases. Therefore, whether each spindle requires maintenance or not can be judged by observing changes in the untwisting tension with the lapse of time. For example, when the number of times and duration of the untwisting tension departing from a predetermined control range increase with the lapse of time, it can be judged that the maintenance of the spindle concerned is necessary.

Figure 12:
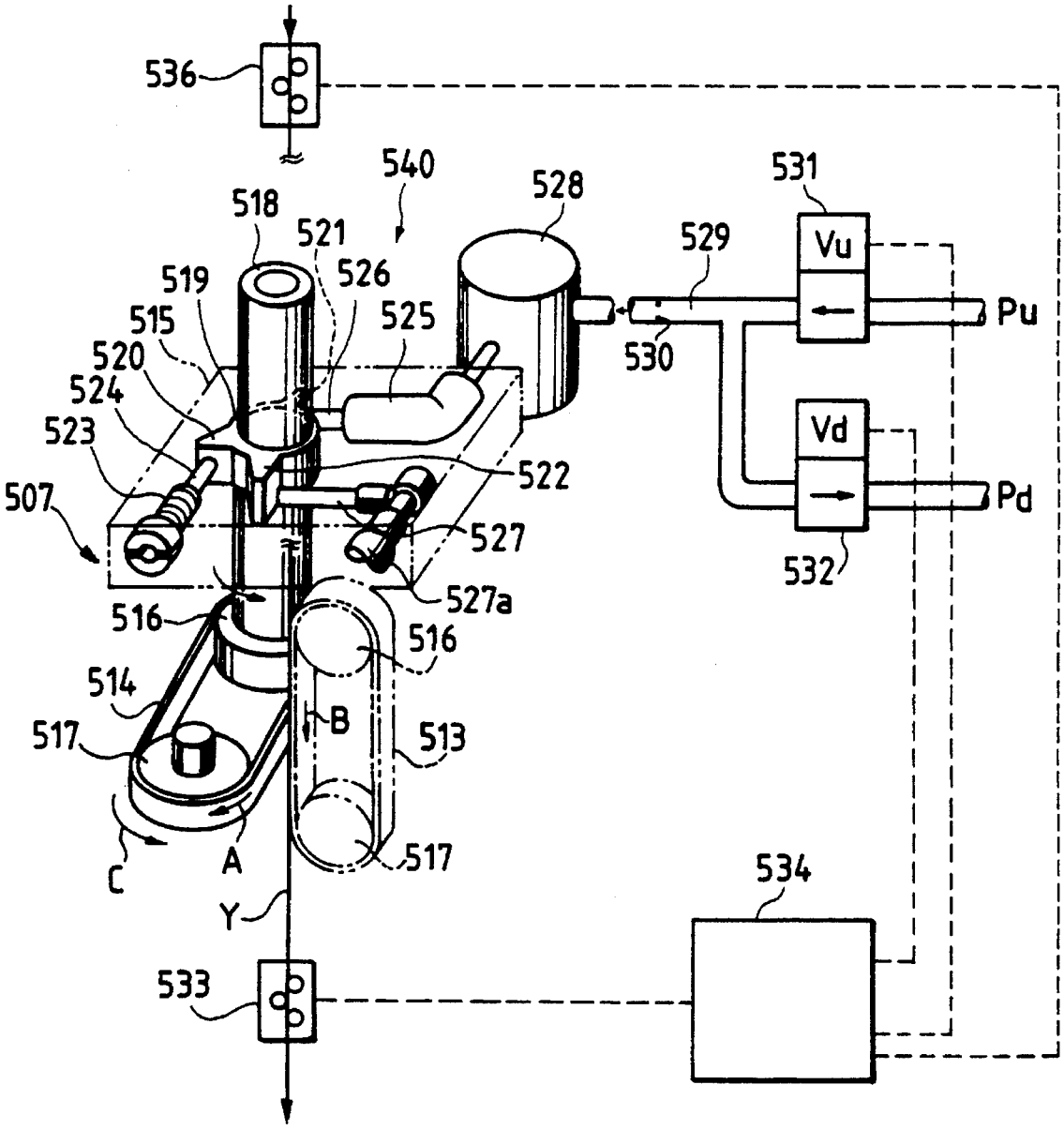
FIG. 12 is a diagram showing the details of a false twist portion in a further embodiment.

FIG. 12 illustrates an embodiment thereof, in which the apparatus construction is almost the same as that shown in FIG. 9. A difference resides in that, in addition to a sensor 533 for detecting an untwisting tension T2 of yarn Y, a sensor 536 for detecting a false twist tension T1 of yarn Y is disposed upstream of belts 513 and 514, and detected signals provided from both sensors 533 and 536 are fed to a controller 534.

First, the false twist tension T1 of yarn Y is detected by the upstream-side sensor 536, then the yarn Y enters a nip twister 507 and is given twist and feed thereby, thereafter the untwisting tension T2 is detected and the yarn is wound up as package. The untwisting tension T2 detected by the downstream-side sensor 533 is fed to the controller 534, and a contact pressure of the nip twister 507 is adjusted on the basis of the detected value thus fed.

More specifically, a target value To of the untwisting tension is inputted beforehand to the controller 534 and also inputted thereto are both upper- and lower-limit values Tu, Td of the untwisting tension in a control range for the target value To. On the basis of the untwisting tension T2 detected by the sensor 533 the controller 534 controls the contact pressure adjusting means 540 to adjust the contact pressure of the belts 513 and 514 so that the untwisting tension T2 is equal to the target value To.

Figure 5:
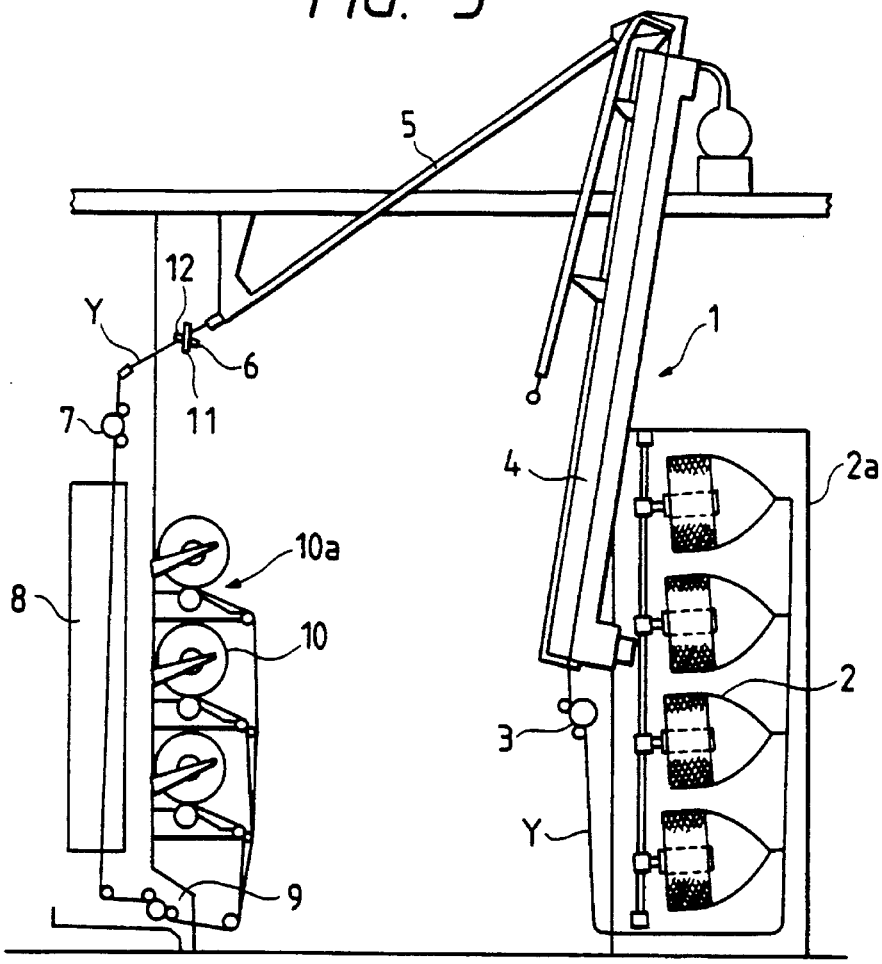
FIG. 5 is a diagram showing a schematic construction of a drawing and false-twisting machine using a false twister.

Further, with respect to each spindle and on the basis of detected values of the untwisting tension T2, the controller 534 judges whether the number of times and duration of the untwisting tension T2 departing from a tolerance limit range has been increased or not with the lapse of time, and if the answer is affirmative, the controller judges that maintenance is necessary for the spindle concerned and gives an alarm or the like using a display unit 546 provided for each spindle. Besides, with respect to each spindle, the controller 534 specifies a portion for maintenance taking also into account changes with time in the detected values of the false twist tension T1. In the case where the primary heater 4 shown in FIG. 5 is stained, an abnormal condition of the untwisting tension T2 increases with the lapse of time and the detected values of the false twist tension T1 also shown an increasing tendency with the lapse of time. Therefore, when both untwisting tension T2 and false twist tension T1 show an increasing tendency, the controller 534 judges that the maintenance of the primary heater 4 is necessary. In the case where the belts 513 and 514 of the nip twister are worn out, there is the tendency that an abnormal condition of the untwisting tension T2 increases with time and the detected values of the false twist tension T1 decreases with time. Therefore, when the untwisting tension T2 and false twist tension T1 show increasing and decreasing tendencies, respectively, it is judged that the belts 513 and 514 are worn out.

The display of an abnormal untwisting tension and that of a spindle requiring maintenance may be done by means of a single display unit common to both, but it is preferable that both displays be done using separate display units.

According to the management method for this false twist machine, whether maintenance of a spindle is necessary or not can be judged by checking changes in the untwisting tension with the lapse of time; for example, the maintenance of the spindle can be judged necessary upon detecting that the number of times and duration of the untwisting tension departing from a preset range have been increasing with the lapse of time. Therefore, it is possible to stabilize the yarn quality.

What is claimed is:

1. A yarn processing device comprising:

a false twister for imparting a false twist to the yarn, the false twister defining a downstream side and comprising a pair of nip members for nipping the yarn, the nip members defining a contact pressure, a sensor for detecting an untwisting tension of a portion of the yarn located on the downstream side of the false twister, adjustment means for adjusting the contact pressure of the nip members, a first valve for causing the adjustment means to increase the contact pressure of the nip members when the untwisting tension detected by the sensor is larger than a first value, a second valve for causing the adjustment means to decrease the contact pressure of the nip members when the untwisting tension detected by the sensor is smaller than a second value, a controller for opening and closing at least one of the first and second valves in response to the untwisting tension detected by the sensor to thereby maintain a substantially constant untwisting tension between the first value and the second value, means for identifying the untwisting tension as abnormal when the untwisting tension detected by the sensor is larger than a third value, the third value being larger than the first value, and means for identifying the untwisting tension as abnormal when the untwisting tension detected by the sensor is smaller than a fourth value, the fourth value being smaller than the second value.

2. A yarn processing device comprising:

a false twister for imparting a false twist to the yarn, the false twister defining a downstream side and comprising a pair of crossed belts for nipping the yarn, the crossed belts defining a contact pressure and a running speed, a sensor for detecting an untwisting tension of a portion of the yarn located on the downstream side of the false twister, adjustment means for adjusting at least one of the contact pressure and the running speed of the crossed belts, first means for causing the adjustment means to increase at least one of the contact pressure and the running speed of the crossed belts when the untwisting tension detected by the sensor is larger than a first value, second means for causing the adjustment means to decrease at least one of the contact pressure and the running speed of the crossed belts when the untwisting tension detected by the sensor is smaller than a second value, a controller for controlling at least one of the first and second means in response to the untwisting tension detected by the sensor to thereby maintain a substantially constant untwisting tension, means for identifying the untwisting tension as abnormal when the untwisting tension detected by the sensor is larger than a third value, the third value being larger than the first value, and means for identifying the untwisting tension as abnormal when the untwisting tension detected by the sensor is smaller than a fourth value, the fourth value being smaller than the second value.

3. A yarn processing device comprising:

a false twister for imparting a false twist to the yarn, the false twister defining a downstream side and comprising a pair of crossed belts for nipping the yarn, the crossed belts defining a contact pressure, a sensor for detecting an untwisting tension of a portion of the yarn located on the downstream side of the false twister, adjustment means for adjusting the contact pressure of the crossed belts, a first valve for causing the adjustment means to increase the contact pressure of the crossed belts when the untwisting tension detected by the sensor is larger than a first value, a second valve for causing the adjustment means to decrease the contact pressure of the crossed belts when the untwisting tension detected by the sensor is smaller than a second value, and a controller for opening and closing at least one of the first and second valves in response to the untwisting tension detected by the sensor to thereby maintain a substantially constant untwisting tension between the first value and the second value, means for identifying the untwisting tension as abnormal when the untwisting tension detected by the sensor is larger than a third value, the third value being larger than the first value, and means for identifying the untwisting tension as abnormal when the untwisting tension detected by the sensor is smaller than a fourth value, the fourth value being smaller than the second value.

4. A yarn processing method comprising:

nipping the yarn between a pair of nip members to thereby impart a false twist to the yarn, the nip members defining a downstream side and a contact pressure, detecting an untwisting tension of a portion of the yarn located on the downstream side of the nip members, increasing the contact pressure of the nip members when the detected untwisting tension is larger than a first value, decreasing the contact pressure of the nip members when the detected untwisting tension is smaller than a second value, determining whether the detected untwisting tension is larger than a third value, the third value being larger than the first value, identifying the untwisting tension as abnormal when the detected untwisting tension is larger than the third value, determining whether the detected untwisting tension is smaller than a fourth value, the fourth value being smaller than the second value, and identifying the untwisting tension as abnormal when the detected untwisting tension is smaller than the fourth value.

5. A yarn processing method comprising:

nipping the yarn between a pair of nip members to thereby impart a false twist to the yarn, the nip members defining a downstream side and a contact pressure, detecting an untwisting tension of a portion of the yarn located on the downstream side of the nip members, increasing the contact pressure of the nip members when the detected untwisting tension is larger than a first value, decreasing the contact pressure of the nip members when the detected untwisting tension is smaller than a second value, determining whether the detected untwisting tension is larger than a third value, the third value being larger than the first value, determining whether the detected untwisting tension is smaller than a fourth value, the fourth value being smaller than the second value, taking up the yarn to which a false twist has been imparted as a package, applying a grade to the package, the grade applied to the package being determined at least on part by whether the detected untwisting tension is larger than the third value and whether the detected untwisting tension is smaller than the fourth value.

6. In a yarn processing device comprising a plurality of spindles, at least one of the spindles comprising a pair of nip members defining a downstream side and a contact pressure, a yarn processing method comprising:

nipping the yarn between the pair of nip members of the spindle to thereby impart a false twist to the yarn, detecting an untwisting tension of a portion of the yarn located on the downstream side of the nip members, increasing the contact pressure of the nip members when the detected untwisting tension is larger than a first value, decreasing the contact pressure of the nip members when the detected untwisting tension is smaller than a second value, determining whether the detected untwisting tension is larger than a third value, the third value being larger than the first value, determining whether the detected untwisting tension is smaller than a fourth value, the fourth value being smaller than the second value, ascertaining a frequency at which the untwisting tension is larger than the third value or smaller than the fourth value, determining whether the ascertained frequency is greater than a predetermined frequency, identifying the spindle as an abnormal spindle when the ascertained frequency is greater than the predetermined frequency.

7. In a yarn processing device comprising a plurality of spindles, each of the plurality of spindles comprising a pair of nip members defining a downstream side and a contact pressure, a yarn processing method comprising:

nipping yarn between the pair of nip members of the spindles to thereby impart a false twist to the yarn, detecting an untwisting tension of a portion of the yarn located on the downstream side of the nip members, increasing the contact pressure of the nip members when the detected untwisting tension is larger than a first value, decreasing the contact pressure of the nip members when the detected untwisting tension is smaller than a second value, determining the number of spindles at which the detected untwisting tension is larger than the first value, determining the number of spindles at which the detected untwisting tension is smaller than the second value, identifying the yarn processing method as abnormal when the number of spindles at which the detected untwisting tension is larger than the first value or smaller than the second value exceeds a predetermined number.

8. The process of claim 7, further comprising:

detecting a first rate at which the plurality of spindles at which the detected untwisting tension is larger than the first value changes over time, detecting a second rate at which the plurality of spindles at which the detected untwisting tension is smaller than the second value changes over time.

* * * * *